United States Patent [19]

Yamamura et al.

[11] 4,016,872

[45] Apr. 12, 1977

[54] MASSAGING APPARATUS

[75] Inventors: Yukio Yamamura; Takafumi Hamabe; Haruo Sugai, all of Hikone, Japan

[73] Assignee: Matsushita Electric Works, Ltd., Osaka, Japan

[22] Filed: Feb. 20, 1976

[21] Appl. No.: 659,925

[30] Foreign Application Priority Data

Feb. 26, 1975 Japan ..... 50-24360

[52] U.S. Cl. ..... 128/44; 128/46; 128/57

[51] Int. Cl.[2] ..... A61H 7/00

[58] Field of Search ..... 128/44–50, 128/60, 61, 56, 57

[56] References Cited

UNITED STATES PATENTS

| | | | |
|---|---|---|---|
| 2,052,656 | 9/1936 | Prien | 128/57 |
| 3,279,462 | 10/1966 | Niquet | 128/57 |
| 3,633,571 | 1/1972 | Shinagawa et al. | 128/44 |

*Primary Examiner*—Lawrence W. Trapp
*Attorney, Agent, or Firm*—Leydig, Voit, Osann, Mayer & Holt, Ltd.

[57] ABSTRACT

A massaging apparatus wherein electric driving means rotates a tubular driving shaft to which opposing disk elements of massaging means is mounted eccentrically as inclined with respect to the shaft's axis and movably in its axial direction. Means for adjusting massaging range determined by mutual distance of the disk elements is mounted on an inner shaft disposed coaxially within the driving shaft and coupled at an end thereto through a clutch. Upon manual operation of the clutch, the inner shaft is disconnected from the driving shaft and the massaging range adjusting means shifts along the inner shaft as rotated by the driving shaft being rotated to move the disk elements toward and away from each other. All the components are compactly mounted onto a single support frame except manual operating means for the driving means and clutch which is remote from apparatus body.

15 Claims, 18 Drawing Figures

MASSAGING APPARATUS

This invention relates to massaging apparatuses and, more particularly, to improvements in massaging apparatuses wherein elements forming a massaging means pivoted to a driving shaft movably in the axial direction of the driving shaft and eccentrically inclined to the axis of the driving shaft are automatically moved in the axial directions of the driving shaft so as to vary massaging range defined substantially by the distance between the elements.

The massaging apparatuses of the kind wherein the massaging elements are fitted as inclined eccentrically to the axis of the driving shaft on the rotary driving shaft so as to perform a massaging operation have already been disclosed, for example, in French Patent No. 1,063,499 and U.S. Pat. No. 3,633,571. In the massaging apparatus suggested in the French Patent No. 1,063,499, a pair of massaging elements is fixed to a driving shaft and the elements cannot be made to relatively approach to or separate from each other and the massaging range connot be varied or adjusted. On the other hand, in the massaging apparatus suggested in the U.S. Pat. No. 3,633,571, the massaging elements are provided to be movable in the axial directions of the driving shaft to approach to or separated from each other slidably with respect to the driving shaft, the massaging elements and sliding members connected to the respective elements so as to move them along the axis of the driving shaft are screwed to a screw rod separated parallelly from the driving shaft and said screw rod is rotated manually at external one side of the apparatus. However, according to such apparatus, there are problems, namely that the user cannot vary the massaging range as desired during the use and that, as two shafts are provided as spaced in parallel with each other, the apparatus cannot be made smaller. The present invention has been suggested to solve problems such as the above in the conventional apparatuses.

A primary object of the present invention is, therefore, to provide a massaging apparatus wherein the massaging means is movable along the axis of a driving shaft during massaging operation and a pair of elements of such massaging means can be automatically caused to approach to or separate from each other during the use so as to obtain a desired messaging range.

Another object of the present invention is to provide a massaging apparatus wherein respective componential members of the apparatus are compactly arranged to render the apparatus small.

A further object of the present invention is to provide a massaging apparatus wherein the massaging elements arranged on the driving shaft are made eccentric and inclined with respect to the axis of the shaft so that an advancing and retreating motion in the direction perpendicular to the axis, that is, a so-called finger-pressure treatment will be provided to the part to be massaged of the user by the eccentric massaging elements and that a rocking motion in the direction parallel to the axis, that is, a repetitive seizing massage treatment will be provided to the part to be massaged by the inclined elements.

A still another object of the present invention is to provide a massaging apparatus wherein such protecting members as will prevent the part to be massaged from enterring too deep beyond the upper surface of the apparatus are attached to the driving shaft intermediately between a pair of the massaging elements and also to the outer inclined surface of each massaging element so that such parts to be massaged as a neck, arms and feet of the user will be prevented from being deeply seized particularly due to separating displacement of the massaging elements.

A yet further object of the present invention is to provide a massaging apparatus wherein a feeding shaft connected with a clutch mechanism for moving the massaging means in the axial directions along the driving shaft so as to render a pair of the members forming the massaging means to approach to or separate from each other is inserted coaxially through said driving shaft so that the two shafts can be arranged in a space for only a single shaft, the massaging range or area can be adjusted even during the massaging operation and the entire apparatus can be made smaller.

Other objects and advantages of the present invention shall be made clear with the following explanation detailed with reference to the drawings, in which.

Figure 1:
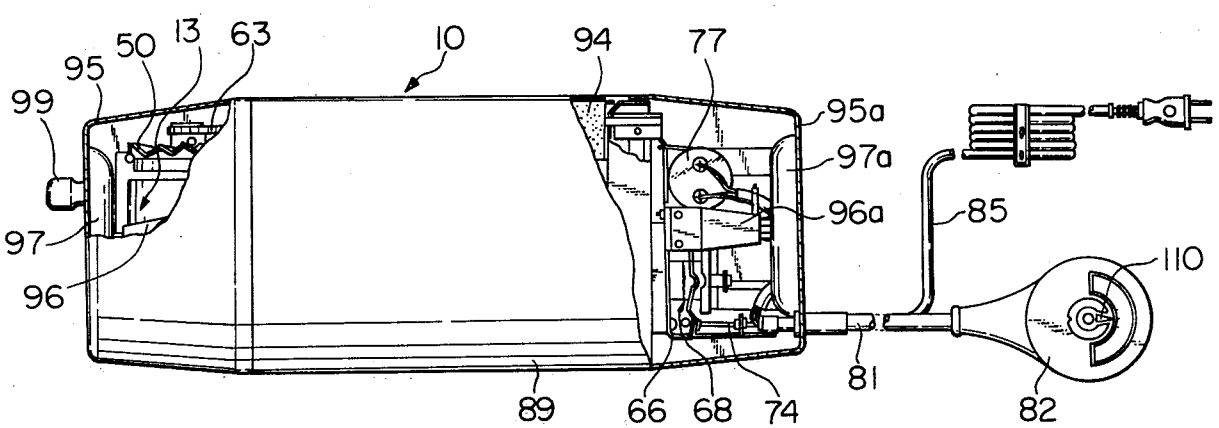
FIG. 1 is a plan view showing an exemplary embodiment of the massaging apparatus of the present invention with a covering partly removed.

While the present invention allows various modifications and selections, an exemplary embodiment thereof shall be shown in the drawings and detailed in the following. Thus, it will be understood that the present invention is not limited to the specific embodiment disclosed but rather all the modifications, alterations and equivalent arrangements included in the scope of appended claims are to be covered by the present invention.

Figure 2:
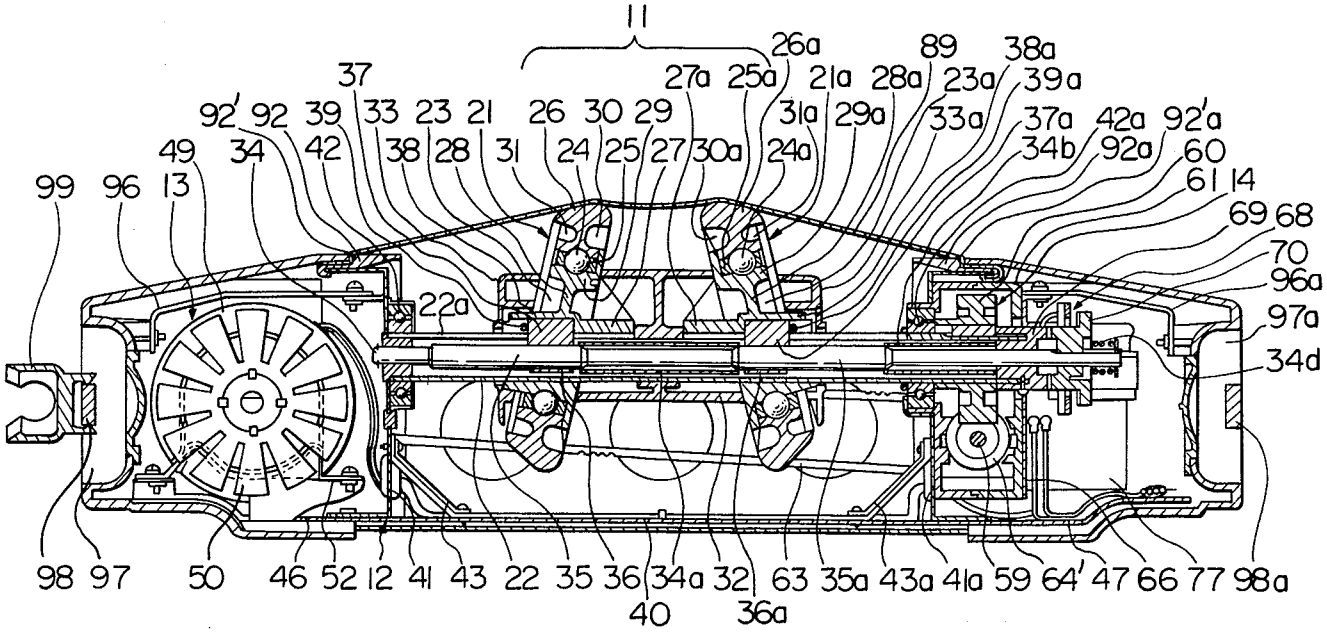
FIG. 2 is a vertically sectioned view taken along the axis of driving shaft of the apparatus shown in FIG. 1.
Figure 3:
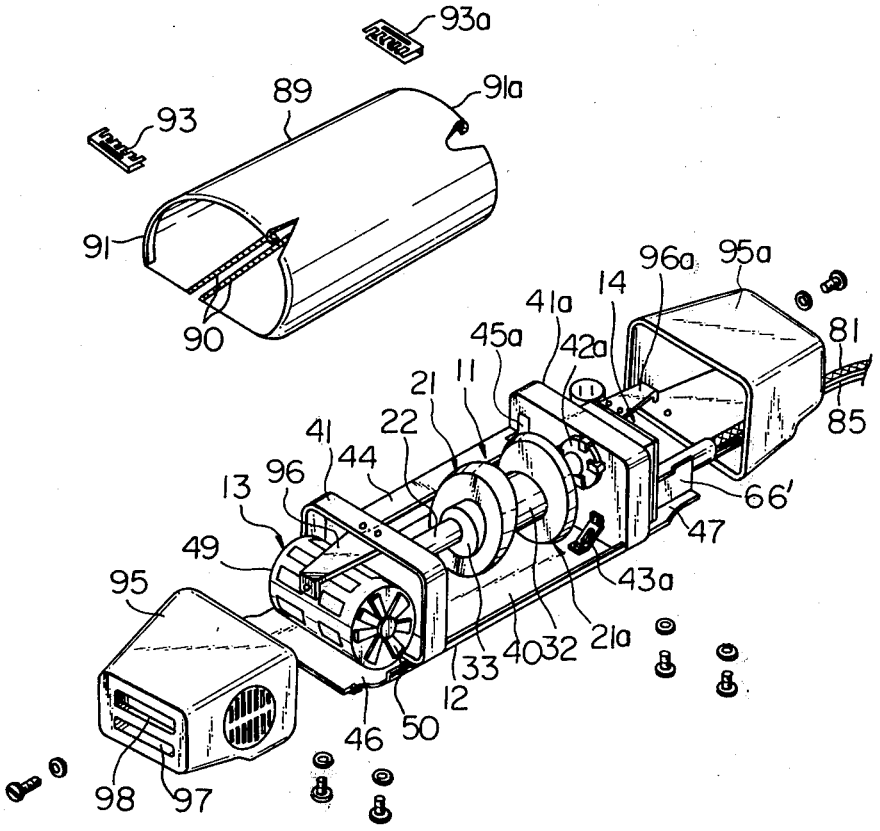
FIG. 3 is a perspective view of the apparatus of FIG. 1 as disassembled for showing the arrangement of principal component means according to the present invention.

Referring to the drawings, a massaging apparatus 10 according to the present invention including massaging means 11 is shown in FIG. 1. As shown in FIGS. 2 and 3, said massaging means 11 is arranged substantially in the middle of a single supporting structure 12, and a driving means 13 is arranged on one side of the supporting structure 12 while a speed reducing means 14 is arranged on the opposite side, with the massaging means 11 disposed between them.

Figure 5:
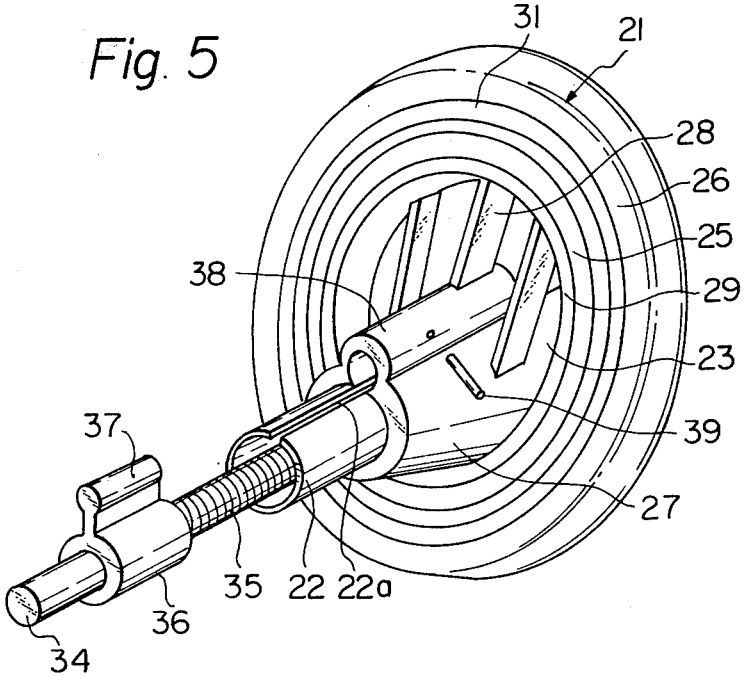
FIG. 5 is a somewhat magnified perspective view specifically of an element of the massaging means in the apparatus of FIG. 1 for showing the relation between the driving shaft supporting the massaging means and a feeding mechanism for moving said massaging means along the axis of said driving shaft.

The massaging means 11 comprises an assembly of a pair of massaging elements 21 and **21*a* which are fitted on a hollow pipe-shaped driving shaft 22 rotated by the driving means 13 so as to be movable in axial directions of the shaft 22. The respective massaging elements 21 and 21*a* are substantially of a disk shape which is eccentric with respect to the axis of the driving shaft 22 so that when they are rotated about the shaft their peripheries will advance or retreat in the direction perpendicular to the axis of the driving shaft. The disk-shaped elements 21 and 21*a* are also inclined with respect to the axis of the driving shaft symmetrically with each other so that as rotated the distance between the respective peripheries will vary in the directions parallel to the axis of the driving shaft 22, that is, as if the opposing elements 21 and 21*a* will perform a rocking motion in said directions. The respective massaging elements 21 and 21*a* further comprise eccentric members 23 and 23*a* directly fitted to the driving shaft 22 slidably in the axial directions of the shaft and massaging rings 26 and 26*a* respectively fitted on the outer peripheral surfaces of said eccentric members 23 and 23*a* through ball bearings 24 and 24*a* held by retainers 25 and 25*a* so that the rings 26 and 26*a* will slidably rotate around the outer peripheral surfaces of the eccentric members 23 and 23*a*. More particularly, as shown in FIG. 5, the eccentric members 23 and 23*a* preferably comprise respectively sleeve parts 27 and 27*a* directly surrounding the driving shaft 22 and eccentric ring parts 29 and 29*a* connected through ribs 28 and 28*a* eccentrically to said sleeve parts 27 and 27*a*. The massaging rings 26*a* and 26*b* are formed of such a material as a synthetic resin, metal or the like to have annular grooves 30, 30*a* and 31, 31*a* on the inner and outer surfaces, and respective outer and inner peripheral surfaces of the eccentric ring parts 29 and 29*a* and massaging ring parts 26 and 26*a* opposing each other are spaced to define race surfaces for the ball bearings 24 and 24*a***.

Figure 4:
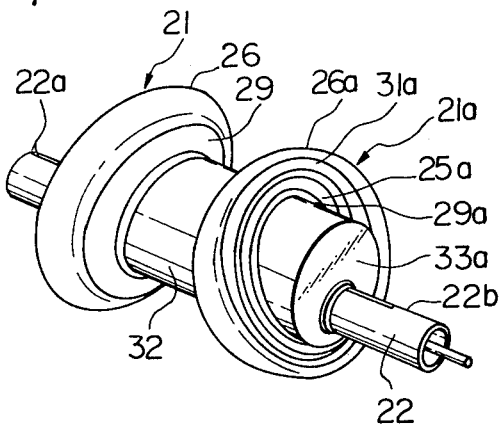
FIG. 4 is a perspective view showing massaging means in the apparatus of FIG. 1 supported on the driving shaft for performing advancing and retreating motions in the direction perpendicular to the driving shaft and rocking motions in the direction parallel to the driving shaft.

According to one feature of the present invention, in order to prevent the user's body part to be massaged from being caused to deeply enter into the space between the massaging elements 21 and **21*a* beyond the outer peripheral surfaces of the elements, that is, the upper surface of the apparatus 10 during the operation, as shown in FIGS. 2 to 4, a cylindrical middle protecting member 32 is arranged on the driving shaft 22 between the massaging elements 21 and 21*a*, and side protecting members 33 and 33*a* of a diagonally-cut cylindrical shape are attached to the outer inclined surfaces of the massaging elements 21 and 21*a*. Both protecting members 32 and 33, 33*a* are formed preferably of plastics. The middle protecting member 32 is provided at its axial ends with the same inclination as that of the massaging elements 21 and 21*a* with respect to the driving shaft 22 so that its both end surfaces will complementarily engage the both massaging elements and, further, the protecting member 32 is eccentrically fixed to the middle of the driving shaft 22 in the same manner as the massaging elements 21 and 21*a* with respect to the shaft's axis so that the enterring of the part to be massaged from any point on the entire outer peripheral surfaces of the massaging elements will be substantially constant over the entire outer peripheral surfaces. The side protecting member 33 and 33*a* are inclined in the same manner as the middle protecting member 32 so that their surfaces opposed to the massaging elements 21 and 21*a* will also complementarily engage the massaging elements and secured eccentrically as snap-fitted to the outer inclined surfaces of the massaging elements 21 and 21*a* by utilizing its own flexibility of, for example, plastic moldings forming the same so that the enterring depth of the part to be massaged will be substantially kept constant in the same manner as in the case of the middle protecting member 32**.

Referring again in particular to FIGS. 2 and 5, a feeding shaft 34 connected at one end to a later described clutch mechanism is inserted coaxially through the driving shaft 22 as held thereto at both ends. The feeding shaft 34 is provided with a pair of screw threaded parts 35 and **35*a* respectively at corresponding positions to the massaging elements 21 and 21*a***.

The directions of the threads of said screw parts 35 and **35*a* are reversed to each other so that, when only the driving shaft 22 is rotated in later described manner, feeding nuts 36 and 36*a* screwed respectively to said screw parts 35 and 35*a* will simultaneously approach to or separate from each other along a slit 22*a* made in the driving shaft 22 to extend in the axial direction of the shaft. The feeding nuts 36 and 36*a* screwed to the screw parts 35 and 35*a* have their radially outwardly projecting neck parts 37 and 37*a* which are inserted respectively in radially outwardly expanded hollow projections 38 and 38*a* of the sleeve parts 27 and 27*a* and are secured at their positions respectively by pins 39 and 39*a* inserted through the middle projections 38 and 38*a***.

The movement in the axial approaching direction of the feeding nuts 36 and **36*a* will be restricted by a central restricting sleeve 34*a* surrounding the feeding shaft 34 between the screw parts 35 and 35*a* and their separating directional movement will be restricted by an end part restricting sleeve 34*b* surrounding the feeding shaft 34 outside the screw part 35*a***.

Figure 6:
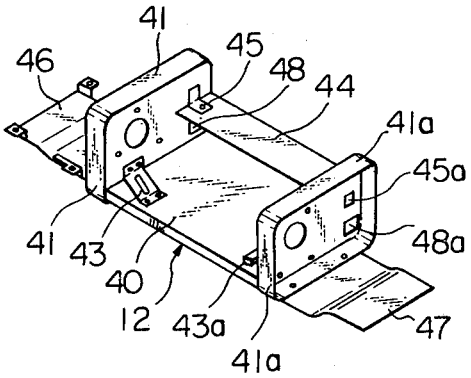
FIG. 6 is a perspective view showing a structure for supporting the massaging means, driving means and a speed reducing means in the apparatus of FIG. 1.

The driving shaft 22 is mounted to such a base plate 40 as schematically shown in FIG. 3 or 6, in such that the shaft's both ends will be born by means of bearings 42 and 42*a* fixed respectively to side frames 41 and 41*a* parallelly erected as spaced on the base plate 40 of the supporting structure 12 preferably integrally. In order to obtain a sufficient mechanical strength, the side frames 41 and 41*a* are formed to be in the form of a shallow box frame opened outward by, for example, drawing such metal plate as an iron plate. In order to reinforce the side frames 41 and 41*a* in lateral directions, reinforcing plates 43 and 43*a* screwed or welded at both ends to them are arranged between the base plate 40 and the side frames 41 and 41*a* and a strengthening side wall 44 raised from the base plate 40 at right angles substantially up to the middle of the height of the side frames 41 and 41*a* between them and further bent inward substantially at right angles is screwed or welded to fixing arms 45 and 45*a* raised inward from the respective side frames 41 and 41*a*. In this case, an extension 46 from the base plate 40 extended out of the side frame 41 may be utilized as a fitting part for the driving means 13 and another extension 47 from the base plate extended out of the opposite side frame 42 may be used as a fitting part for the speed reducing means 14. Further, holes 48 and 48*a* for inserting a belt lining the driving means 13 and speed reducing means 14 are made in said side frames 41 and 41*a*.

Figure 7:
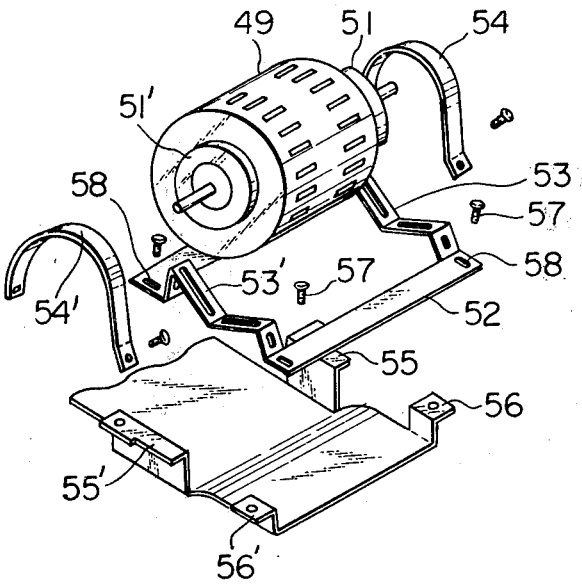
FIG. 7 is a perspective view of a means for elastically supporting the driving means in the apparatus of FIG. 1.

An electric motor 49 forming the driving means is, in the present instance, at least of a reversible type and preferably of a variable speed type. The motor is provided with cooling fans 50 (only one is illustrated) fitted on both sides of the rotary shaft as shown in FIGS. 2 and 3 and is elastically supported on the driving means fitting part 46. For this purpose, as shown in FIG. 7, the motor 49 is provided with ring-shaped elastic members 51 and 51' attached to respective flanges at both ends of the motor body and is mounted at the elastic members 51 and 51' on opposing arms 53 and 53' of a fitting frame 52 which are bent into substantially a V-shape so as to provide an elasticity and held to the fixing part 46 while retaining a sufficient elasticity of the bent arms 53 and 53' by means of fixing bands 54 and 54' which are secured through the fitting frame 52 to supporting pieces 55, 55' and 56, 56' raised from both side parts of the fitting part 46 by means of screws 57 which are passed through holes 58 made in four corners of the fitting frame 52. The holes 58 are preferably made in slot shape so that the position of the motor 49 can be slightly moved in the horizontal directions together with the fitting frame 52, whereby it is insured that the optimum tension of a later described belt 63 can be obtained by properly positioning the motor 49.

Figure 8A:
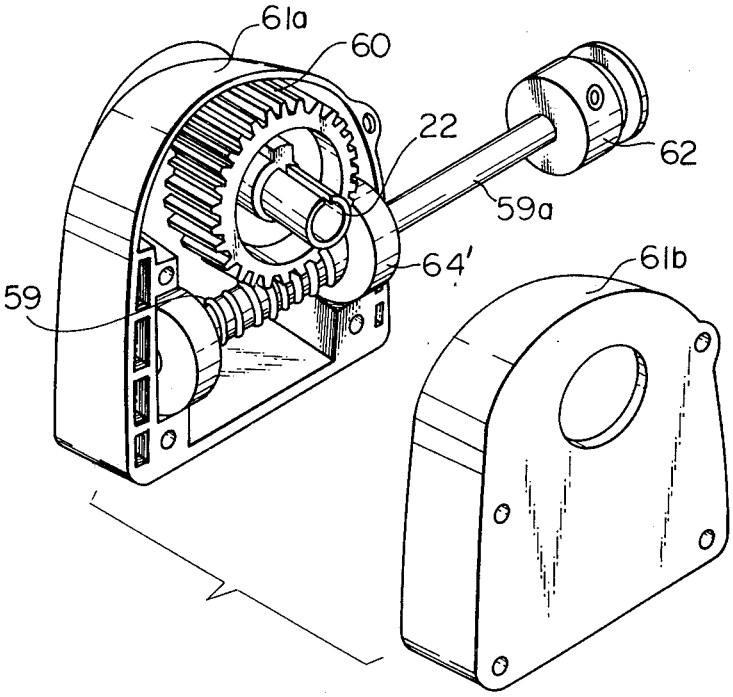
FIG. 8A is a perspective view showing the speed reducing means as somewhat magnified and with one half gear box disassembled in the apparatus of FIG. 1.
Figure 8B:
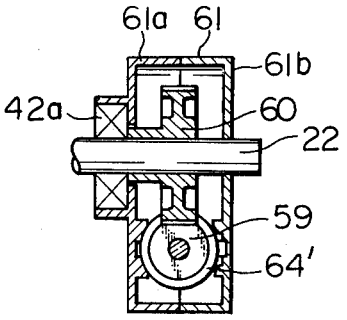
FIG. 8B is a fragmentary sectioned view of the speed reducing means of FIG. 8A taken along the vertical plane including the axis of the driving shaft.
Figure 8C:
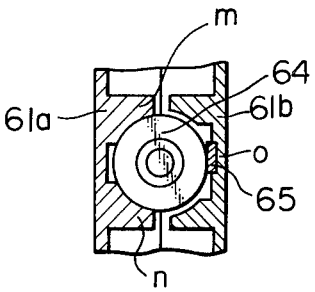
FIG. 8C is a fragmentary sectioned view similar to FIG. 8B for showing a bearing part of the speed reducing means.

Further, according to another feature of the present invention, the speed reducing means 14 is arranged on the other fitting part 47 of the supporting structure 12. As shown in FIGS. 2, 8A and 8B, the speed reducing means 14 comprises a worm gear 59 and worm wheel 60 meshing with each other and contained in a gear box 61 comprising corresponding box halves 61*a* and 61*b*. To the box half 61*a*, a bearing 42*a* for bearing the driving shaft 22 is fitted outside and the box half 61*a* is fixed to the side frame 41*a* of the supporting structure 12. A worm gear shaft 59*a* integral with the worm gear 59 projects out of the gear box 61 and a pulley 62 is mounted to projected end of the shaft 59*a*. The belt 63 is stretched between said pulley 62 and the rotary shaft of the motor 49. The worm wheel 60 in mesh with the worm gear 59 to transmit the driving force of the motor to the driving shaft 22 at a reduced speed is borne by the bearing 42*a* and is connected through a key to the outer peripheral surface of the driving shaft 22 passing through the gear box 61. On the other hand, as shown in FIG. 8C, bearings 64 and 64' for bearing respective ends of the worm gear 59 will be held by three supporting parts *m*, *n* and *o* of the box halves 61 and 61*a* when they are jointed. Further, an elastic body 65 is attached to one of the three supporting parts so as to absorb any tolerance of the bearing and to prevent any abnormal sounds from occurring when the gear meshes.

Figure 9A:
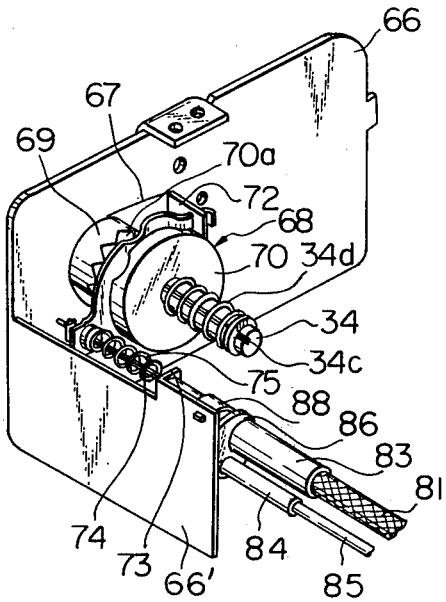
FIG. 9A is a fragmentary perspective view with a somewhat magnified scale of clutch mechanism in the apparatus of FIG. 1 which cooperates with the driving shaft and feeding shaft.
Figure 9B:
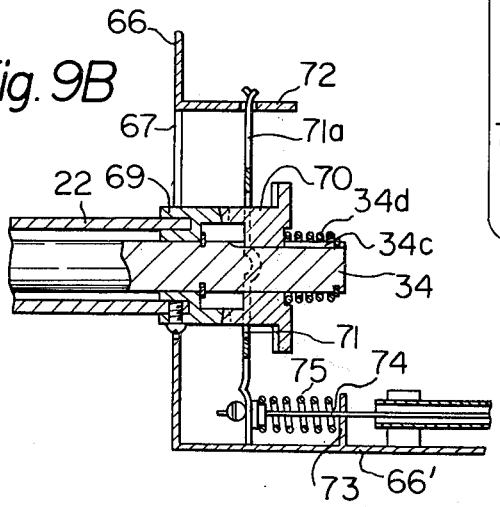
FIG. 9B is a sectioned view of the clutch mechanism of FIG. 9A taken along the horizontal plane including the axis of the driving shaft.
Figure 9C:
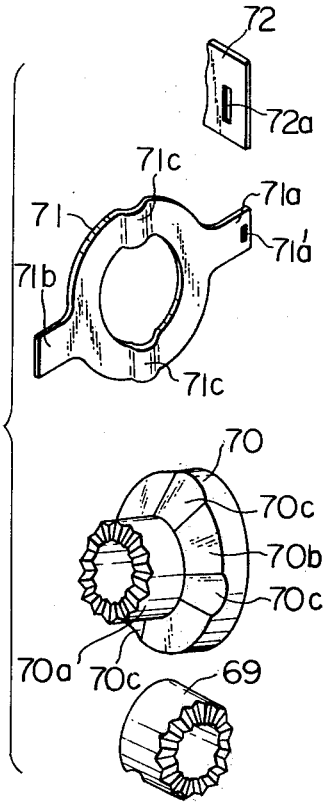
FIG. 9C is a perspective view as disassembled showing partial members of the clutch mechanism of FIG. 9A with a further enlarged scale.

Referring now to the clutch mechanism, as shown in 9A and 9B, on L-shaped supporting plate 66 bent substantially at right angles to form a bent part 66' is fixed to the outside surface of the gear box 61. The clutch mechanism 68 comprises stationary and movable clutch parts 69 and 70 which are connected respectively to the driving shaft 22 at it end projecting slightly out of a through hole 67 made in the L-shaped supporting plate 66 and to the coaxial feeding shaft 34 further projecting out of said driving shaft 22. The stationary clutch part 69 is fixed by a screw to the end part of the driving shaft 22 and the movable clutch part 70 is fitted on the feeding shaft 34 slidably along a key groove 34*c* in the shaft 34 and connected thereto through a key so as to rotate normally together with the feeding shaft 34. A spring 34*a* engaged at one end with the movable clutch part 70 and at the other end with a C-shaped washer secured to an end of the feeding shaft 34 is arranged so as to urge the both clutch parts 69 and 70 into mesh with each other. In order to separate the movable clutch part 70 from the fixed clutch part 69, a substantially ring-shaped disengaging lever 71 having a pair of opposing arms 71*a* and 71*b* extended symmetrically is loosely fitted to outer periphery of main cylindrical body 70*a* of the movable clutch part 70. The lever 71 has at its ring-shaped body, in the present instance, a pair of curved projections 71*c*, whereas the movable clutch part 70 is provided with a flange part 70*b* extending radially from the body 70*a* and having a plurality of concave parts 70*c* complementary to the projections 71*c* of the lever 71 (see FIG. 9C), so that the concave parts 70*C* will resiliently engage over the projections 71*c* for preventing slipping disengagement between the movable clutch part 70 and the disengaging lever 71. In order to perform the disengaging and engaging operations of the movable clutch part 70 with the stationary part 69, an arm 71*a* provided with a cut 71*a'* in the end part of the lever 71 is pivoted to a supporting arm 72 erected from the supporting plate 66 adjacent the through hole 67 by inserting the arm 71*a* through a hole 72*a* in the supporting arm 72 and then bending the both end parts separated by the cut 71*a'* in the directions reverse to each other, while the other arm 71*b* is connected to an operating wire 74 guided by a projecting piece 73 raised inward from the bent part 66' of the plate 66 and is given such spring load as will separate the disengaging lever 71 from the movable clutch part 70 by means of a tension spring 75 arranged between the arm 71*b* and the projecting piece 73.

Figure 10A:
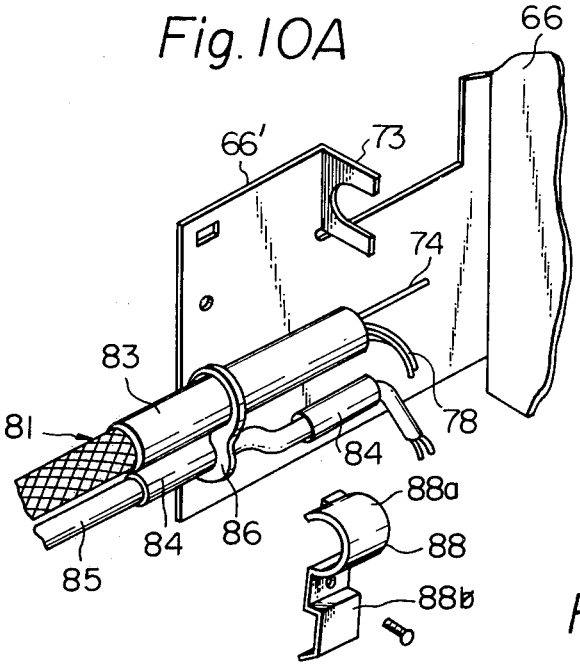
FIG. 10A is a perspective view showing a part of the clutch mechanism of FIG. 9A as seen from another side thereof.
Figure 10B:
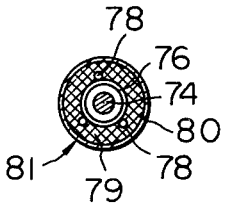
FIG. 10B is a magnified sectioned view of an operating cord in the mechanism of FIG. 9A or 10A.

As shown in FIG. 10B, the operating wire 74 is inserted through an outer tube 76 and such electric lead wires 78 as reach a condenser connected with the motor 49 and cotton yarns 79 are provided on the outer periphery of the outer tube 76, which are coated with an outer skin 80 made of knit yarns to form an operating cord 81. This operating cord 81 is pulled long out of the apparatus and is connected to a later detailed operating box 82. Further, the operating cord 81 is coated with a protective tube 83 and is combined by a collecting ring 86 with a current source connecting cord 85 similarly coated with a protective tube 84 for supplying electricity to the motor 49 form a current source, at the parts covered by the protective tubes 83 and 84. Further, the operating cord 81 and current source cord 85 are fitted at the ends thus coated with the protective tubes respectively in receiving parts 88*a* and 88*b* formed in a fixture 88 which is engaged at an end to an engaging hole 87 made in the bent part 66' and fixed thereto by means of a screw so that the operating cord 81 will be embraced by a cut in the projecting piece 73.

When all the components are arranged on the single supporting structure 12, a central cover 89 formed of such a material as a vinyl leather, leather, cloth or the like which is soft enough for ensuring the massaging operation with the massaging means 11 is fitted over the apparatus 10 in the middle and jointed by means fasteners 90 on the back of the apparatus. It is preferable that, in case the cover 89 is formed particularly of a leather or the like material which is likely to be damaged, the cover 89 will be lined with a nylon cloth or the like so as to reduce frictions of the cover with the massaging rings 26, 26*a* and thus to prevent the cover from being easily damaged. Further, the cover 89 has turned over edges 91 and 91formed at both end parts except the part covering the bottom surface, which are fitted to the open edges of the side frames 41 and 41*a* of the supporting structure 12 through spacers 92 and 92*a* of a relatively soft material (see FIG. 2 and fixed to said open edges by means of at least a pair of clips 93 and 93*a* having pawls which can bite the cover (FIG. 3). It is preferable further that, before the apparatus is enclosed with the cover 89 in the middle part, the strengthening wall 44 of the supporting structure 12 is covered with such cushioning body 94 (see FIG. 1) as urethane foam material. Both end parts of the apparatus are covered with rigid caps 95 and 95*a* formed preferably of plastics and provided with vents to rigidly cover the driving means and speed reducing means. These caps 95 and 95*a* are fitted respectively to the side frames 41 and 41*a* over the turned over edges of the cover 89 and fixed with screws to downward bent ends of outward extended supporters 96 and 96*a* of the side frames 41 and 41*a* as well as to the supporting plates 66, 66' and the respective corresponding fitting parts 46 and 47 also with screws from the bottom surface. Respective stepped parts 92' and 92'*a* of the spacers 92 and 92*a* are so provided as to compensate step differences from the caps when the caps 94 and 95*a* are fixed to the side frames. Concavities 97 and 97*a* are formed on the end surfaces of both caps so as to provide holdable means for allowing the apparatus to be carried by hand and such grips 98 and 98*a* as are bridged over said concavities 97 and 97*a* extend in the horizontal direction. It is preferable that a removable holder 99 for suspending the cord box 82 is fitted to one of said grips, specifically the grip 98 in the present case.

Figure 11A:
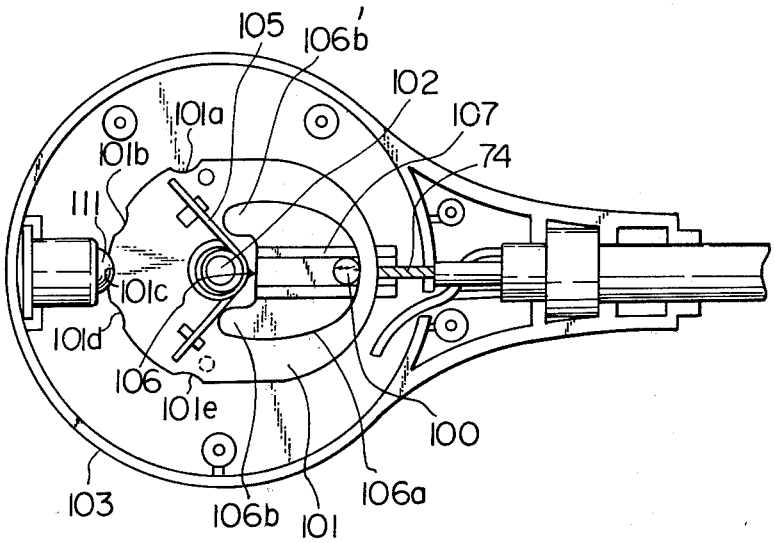
FIG. 11A is a fragmentary magnified plan view of an operating box with a covering rotary disk removed for showing operating mechanism therein and connected to an end of the operating cord of FIG. 9A or 10A.
Figure 11B:
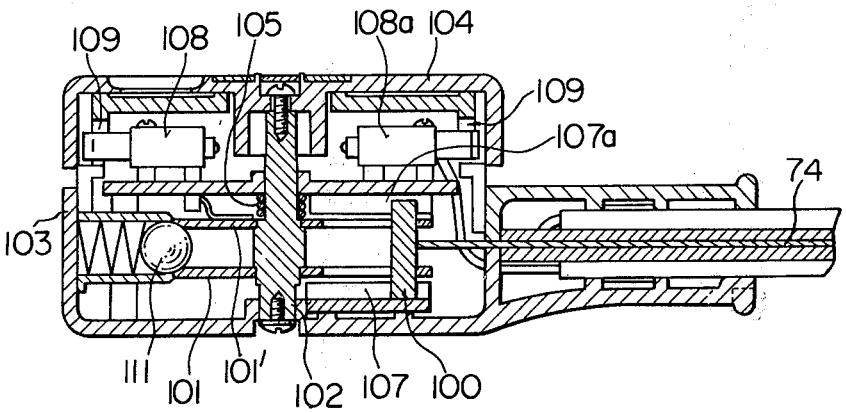
FIG. 11B is a vertical sectioned view of the operating box of FIG. 11A with the rotary disk mounted.

Further, as shown particularly in FIGS. 11A and 11B, the before described operating box 82 shown in FIG. 1 comprises an operating mechanism for the operating wire and a switching mechanism operatively connected to said operating mechanism. The operating mechanism includes a pair of upper and lower pulling plates 101 and 101' which will pull an end pin 100 coupled to an end part of the operating wire 74. These pulling plates 101 and 101' are so formed as to be operatively connected to a rotatable control disk 104 disposed on the upper surface of a casing 103 through a vertical shaft 102 and are so biased as to be always returned to the center position by means of a properly provided returning spring 105. In this case, the end pin 100 is inserted vertically in apertures 106 made in the pulling plates 101 and 101' to match each other and respectively having an arcuate edge 106*a* which reduces the distance from the vertical shaft 102 to the arcuate edge in the aperture toward both end edge parts 106*b* and 106*b'* of the aperture positioned adjacent the shaft 102, and both ends of the pin 100 are slidably fitted in upper and lower guide slots 107 and 107*a* extending from the end position of the wire 74 to the shaft 102. Thus, upon manual rotation of the control disk 104 to either direction about the shaft 102 as the center, the plates 101 and 101' will be rotated and the end pin 100 will slide along the arcuate edge 106*a* and will be gradually pulled toward the shaft 102 together with the wire 74 as guided by the slots 107 and 107*a* until either one of the end edge parts 106*b* and 106*b'* of the apertures 106 reaches. When the operating wire 74 is thus pulled, the disengaging lever 71 connected to the other end of the wire 74 will be rotated about the engaged end 71*a* to the arm 72 as the center so that the movable clutch part 70 of the clutch 68 will be separated from the fixed clutch part 69.

The control disk 104 is provided therein with a pair of switch operating members 109 which alternately operate a pair of microswitches 108 and 108*a* arranged symmetrically on both sides of the vertical shaft 102 as filed to a stationary intermediate plate 102*a*. These operating members 109 are so formed as to continuously keep one microswitch 108 "ON" before and until the end edge part 106*b* of the aperture 106 reaches the position of the end pin 100. In other words, the arrangement is such that, as soon as the disk 104 of the operating box 82 is rotated to a position where the indication by the mark 110 changes from "O" of "OFF" state to a normal rotation position "N" or to a reverse rotation position "R", the microswitch 108 will be switched "ON" and, also when small width position "S" or wide width position "W" is indicated, the switch will be continuously kept "ON". On the other hand, notches 101*a* to 101*e* are formed in the parts corresponding to the respective said positions of the plates 101 so that, in case any of the positions "O", "N", "R", "S" and "W" is reached against the returning force of the returning spring 105, the pulling plates 101 and 101' will be stopped and held in a particular position by means of a ball 111 resiliently urged into engagement in any notches by a spring load applied to the ball.

Figure 12:
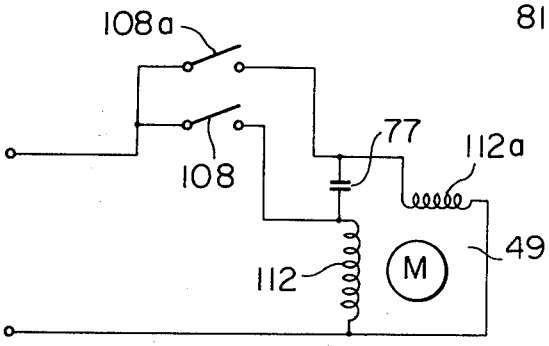
FIG. 12 is an electric circuit diagram of the apparatus of the present invention.

Further, it will be easily understood by one skilled in the art that, in the apparatus formed as described above, the arrangement may be made in such manner that, in case a rotation of the control disk 104 from "O" position over the position "N" from "O" causes one microswitch 108 shown in FIG. 12 to be set "ON" and the motor 49 having the condenser 77 inserted between coils 112 and 112*a* is rotated in one direction, then a reverse directional rotation of the disk 104 from the "O" position over the position "R" will cause the other microswitch 108*a* to be set "ON" so as to run the motor 49 in the reverse direction.

The operation of the present invention shall now be detailed in the following. According to the present invention, the operation is performed by means of the operating box 82 remote sufficiently from the apparatus body by sufficiently extending the operating cord out of the body. Now, when the current source cord 85 is connected with a current source and the control disk 104 of the operating box 82 is rotated to close either one of the microswitches to operate the driving means 13, the speed reducing means 14 will be operatively connected to the driving means 13 through the belt 63 and the feeding shaft 34 connected to the driving shaft 22 through the clutch mechanism 68 in engaged state will be rotated together with the driving shaft 22 coupled to the speed reducing means 14. Therefore, the massaging means 11 will be rotated by the shaft 22 through the feeding nuts 36 and **36*a* connected respectively to the eccentric members 23 and 23*a* so as to advance or retreat in the direction perpendicular to the axis of the driving shaft 22 due to their mounting's eccentric élements so as to provide the finger pressure treatment to the user's body part to be massaged while periodically varying their distance in the direction parallel to the said axis due to their mounting's inclined elements so as to provide repetitive seizing treatment to the part to be massaged. In such case, responsive to the rotating direction of the control disk 104**, any desired rotating direction of the massaging means will be obtained. In other words, such massaging that will push down from above the part to be massaged or that will seize or rub the part up from below will be able to be obtained.

In addition, when the control disk 104 of the operating box 82 is sufficiently rotated to the position "W" or "S", the end pin 100 will be moved toward the vertical shaft 102, the operating wire 74 will be pulled and the disengaging lever 71 will be rotated. Therefore, the movable clutch part 70 will be separated from the fixed clutch part 69 by the rotated disengaging lever 71, the curved projections **71*c* will engage in the curved concaves 70*c* of the movable clutch part 70 and the movable clutch part 70 will become stationary. In such case, the feeding shaft 34 coupled to the movable clutch part 70 will become also simultaneously stationary but, so long as the microswitch remains closed, the driving shaft 22 will rotate and the feeding nuts 36 and 36*a* will be rotated respectively about the screw parts 35 and 35*a* of the feeding shaft 34. Since the directions of the threads of said screw parts 35 and 35*a* are reversed to each other, in one rotating direction of the driving shaft 22, the massaging elements 21 and 21*a* in the pair will separate from each other. In the present instance, in the position "W" of the control disk 104, the massaging elements 21 and 21*a* are separated from each other. On the other hand, a rotation of the driving shaft 22 in the direction reverse to the above described rotating direction, which is achieved by rotating the control disk 104 to the position "S", will cause the massaging elements 21 and 21*a*** to approach each other, contrarily to the above description.

Further, in the present embodiment, when the feeding nuts 38 and **38*a* coupled to the massaging elements 21 and 21*a* approach each other to contact the middle restricting sleeve 34*a*, a force resisting the spring 34*d* biasing the movable clutch part 70 will be produced and the movable clutch part 70 will slip with respect to the disengaging lever 71. Therefore, the curved projection 71*c* and curved concave 70*c* will be disengaged with each other and, by the following rotation of the movable clutch part 70, whenever the projections 71*c* and concaves 70*c* engage with each other, a colliding sound will be generated so that the closest position of them will be easily sensed by the user. On the other hand, when the feeding nuts 38 and 38*a* separate from each other and one of the feeding nuts contacts the end part restricting sleeve 34*b***, the movable clutch part will also slip in the same manner and similar colliding sounds will be generated so that the most separated position of the both clutch parts may be readily sensed. Since the clutch mechanism has thus a slipping action, the clutch mechanism contributes to avoiding an overmassaging action on the user's body and an overloading on the motor.

According to the above described massaging apparatus of the present invention, the shaft included in the massaging range adjusting means is rotated together with the driving shaft so that, by selectively stopping the shaft of the adjusting means, even during the massaging operation, the massaging range will be able to be automatically varied. Further, by mounting the shaft of the adjusting means concentrically with the driving shaft, the apparatus can be made small enough and easy to carry. By sufficiently extending the operating cord out of the apparatus body, the apparatus can be operated in a position remote from it and, therefore, for example, even in the case of applying the apparatus to the back part of the user, the operation and its selective control may be easily made. In addition, by using the clutch mechanism having a slipping action, the user's body as well as the driving means and speed reducing means can be well protected.

What is claimed is:

1. A massaging apparatus comprising a support means, a driving shaft pivoted to said support means, means for driving said driving shaft, massaging means mounted to said driving shaft eccentrically as inclined with respect to the axis of the driving shaft, and a massaging range adjusting means including another shaft rotated together with said driving shaft and moving said massaging means along the axis of the driving shaft.

2. A massaging apparatus according to claim 1 wherein said driving shaft is made hollow and the other shaft of the massaging range adjusting means is mounted concentrically in the driving shaft.

3. A massaging apparatus according to claim 1 which further comprises a clutch mechanism connecting and disconnecting joint rotation of said driving shaft and the other shaft.

4. A massaging apparatus according to claim 3 which further comprises a mechanism for operating a rotation or reverse rotation of the driving means, means for disengaging said clutch mechanism, and an operating box sufficiently remote from the apparatus through an operating cord.

5. A massaging apparatus according to claim 1 wherein said support means comprises side frames and extensions respectively extended out of said side frames, and said massaging means is provided in the middle of said side frames and said driving means and speed reducing means are arranged on each of said extensions.

6. A massaging apparatus according to claim 5 wherein a clutch mechanism is further provided so as to continue and discontinue cooperative rotation of the driving shaft and another shaft by means of a clutching lever, said speed reducing means is housed in a gear box fixed to said one of the extensions of the support means, and said clutch mechanism is secured to a supporting plate secured outside said gear box.

7. A massaging apparatus according to claim 1 wherein said massaging means comprises a pair of substantially disk-shaped and spaced massaging elements coupled to said driving shaft eccentrically and as inclined with respect to the axis of the shaft, and a protective member is disposed between and both outer sides of said elements similarly eccentrically and inclined as retracted from the elements.

8. A massaging apparatus according to claim 3 wherein said another shaft is coupled to said driving shaft through said clutch mechanism engageably and disengageably therewith and inserted coaxially inside the driving shaft, and feeding nuts mounted on the other shaft are connected parts of said massaging means subjected directly to driving force from the driving shaft so as to be caused to approach to or separate from each other in the axial direction of the other shaft.

9. A massaging apparatus according to claim 8 wherein said driving shaft has a slit which extends in the axial direction of the driving shaft and through which said feeding nuts are movable, and said the other shaft is provided with screw parts which are threaded in the directions reverse to each other, on which the respective nuts are screwed.

10. A massaging apparatus according to claim 3 wherein said clutch mechanism comprises a clutch part fixed to an end of said driving shaft, a movable clutch part mounted to said other shaft slidably only in axial directions of the other shaft and a lever for engaging and disengaging said fixed and movable clutch parts to continue and discontinue cooperative rotation of the other shaft with the driving shaft.

11. A massaging apparatus according to claim 10 wherein said movable clutch part is normally receiving a spring force biasing the same toward said fixed clutch part and is provided with a recess at a part engaging a projection provided in said lever, so that when the lever is actuated a brake force will be provided by the lever to the movable clutch part with respect to rotational direction thereof.

12. A massaging apparatus according to claim 11 wherein said lever is rockable about an end, and a pulling wire extended out of the apparatus is connected to the other free end of the lever.

13. A massaging apparatus according to claim 1 wherein a covering of the apparatus comprises a soft middle cover fitted over said support means including said massaging means rigid caps covering respectively said driving means and speed reducing means disposed on both sides of the support means.

14. A massaging apparatus comprising a support means including a pair of side frame erected substantially vertically and separated from each other and having extensions respectively out of said side frames, a driving shaft mounted and pivoted between said side frames, massaging means comprising a pair of substantially disk-shaped elements mounted to said driving shaft movably in axial directions of the shaft, respective said elements including a central part subjected directly to a driving force from the driving shaft and a peripheral part fitted through bearings to said central part and being mounted to the driving shaft eccentrically as inclined symmetrically with respect to the axis of the driving shaft, a driving means supported elastically on one of said extensions of said support means on one side of said massaging means and connected with a current source, a speed reducing means connected to said driving means through a belt and supported on the other extension on the side opposed to the driving means, said speed reducing means including a worm gear born by bearings supported elastically at at least one point in a gear box and being connected to the driving shaft, a clutch mechanism secured to outside surface of said gear box and including a clutch part fixed to an end of the driving shaft and a movable clutch part resiliently engaging said fixed clutch part, a second shaft coupled to said movable clutch part of the clutch mechanism and having screw threads of directions reverse to each other, said second shaft having a pair of feeding nuts screwed onto said screw threads respectively and coupled to the respective central parts of the massaging elements, an operating box including a manual operating means connected to an end of an operating cord extended out of the support means, said cord including a pulling wire connected to the movable clutch part for separating the part from the fixed clutch part so as to be capable of operating the clutch mechanism together with ON-OFF operations of the driving means, an electric current source code connected through said operating means to the driving means, and a covering means comprising a soft member fitted between the side frames of the support means to cover the message means and rigid members fitted respectively to each of the side frames to cover the driving means and speed reducing means respectively.

15. A massaging device for massaging a part of the body comprising, in combination, a frame, a hollow rotary drive shaft journaled in the frame, a motor coupled to the drive shaft, a pair of massaging elements in the form of discs mounted on the drive shaft in axially spaced positions, rings surrounding the respective discs and having presented outer surfaces, bearings interposed between the rings and the discs so that the discs are free to rotate within the rings, the discs being mounted in oppositely cocked positions on the shaft so that the discs and the rings thereon undergo wobbling movement as the drive shaft rotates with the presented outer surfaces of the rings moving cyclically toward and away from one another to provide a component of massaging action parallel to the engaged surface of the body, means including an adjusting shaft telescoped into the drive shaft and coupled to at least one of the discs for changing the axial spacing thereof, the adjusting shaft being normally rotatable with the drive shaft but having settable means for relatively rotating the adjusting shaft in opposite directions with respect to the drive shaft.

* * * * *